United States Patent [19]

Kato et al.

[11] Patent Number: 5,038,174

[45] Date of Patent: Aug. 6, 1991

[54] IMAGE FORMING APPARATUS HAVING A VENTILATED IMAGE FORMING UNIT

[75] Inventors: Junichi Kato, Sagamihara; Masahiro Goto, Kawasaki; Koichi Suwa, Yokohama; Hideyuki Yano, Yokohama; Takahiro Inoue, Yokohama, all of Japan

[73] Assignee: Canon Kabushiki Kaisha, Tokyo, Japan

[21] Appl. No.: 575,370

[22] Filed: Aug. 30, 1990

[30] Foreign Application Priority Data

Aug. 31, 1989 [JP] Japan ..... 1-223239

[51] Int. Cl.[5] ..... G03G 15/00; G03G 21/00

[52] U.S. Cl. ..... 355/215; 355/210

[58] Field of Search ..... 355/215, 30, 210, 298, 355/221; 361/521; 174/16.1, 15.1

[56] References Cited

U.S. PATENT DOCUMENTS

| | | | |
|---|---|---|---|
| 4,040,731 | 8/1977 | Nishikawa | 355/200 |
| 4,540,268 | 9/1985 | Toyono et al. | 355/210 |
| 4,720,727 | 1/1988 | Yoshida | 355/215 |
| 4,851,960 | 7/1989 | Nakamura et al. | 361/225 |
| 4,853,735 | 8/1989 | Kodama et al. | 355/215 |

FOREIGN PATENT DOCUMENTS

| | | | |
|---|---|---|---|
| 0194271 | 8/1987 | Japan | 355/215 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus has an image forming unit which is detachably mounted in the stationary main part of the apparatus. The unit includes an image carrier with a photosensitive layer, a charging device capable of electrostatically charging the image carrier in contact therewith, and a housing supporting the image carrier and the charging device and provided with an exposure opening. An air flow is positively formed such that, with the image forming unit mounted in a predetermined mounting portion in the apparatus, air flows from regions near both ends of the image carrier towards the exposure opening past a region where the charging device contacts the image carrier. With this arrangement, ozone generated in the image forming unit due to operation of the contact type charging device is efficiently carried away from the image forming unit, thus eliminating generation of image defects attributable to presence of ozone and other discharge products.

27 Claims, 6 Drawing Sheets

IMAGE FORMING APPARATUS HAVING A VENTILATED IMAGE FORMING UNIT

BACKGROUND OF THE INVENTION

1. Field of the Invention

The present invention relates to an image forming apparatus having charging means for charging an image carrier in contact therewith. More particularly, the present invention relates to an image forming apparatus of the type mentioned above, wherein the charging means is integrated with the image carrier so as to form a unit which can be mounted on and demounted from the stationary main part of the image forming apparatus.

2. Description of the Related Art

In general, an image forming apparatus has a charging device for charging an image carrier, such as, a photosensitive member. The charging device used in this type of image forming apparatus is a corona discharger which charges the photosensitive member by a corona discharge from discharge electrode wires under application of a high voltage to the discharge electrode wires. However, this type of charging device suffers from a disadvantage in that an image defect known as "blur" tends to occur due to denaturation of the image carrier surface by ozone produced as a result of the corona discharge, particularly when the concentration of ozone is high. The ozone generated in the charging device also reacts with nitrogen in the air to form nitrogen oxides which are deposited on the surface of the image carrier, i.e., the surface of the photosensitive member, so as to reduce electrical resistance of the surface, with the result that the charges forming an electrostatic latent image on the photosensitive member are undesirably diffused to cause an image defect known as "flow of image". In order to eliminate these image defects, it is necessary to ventilate the space in and around the charging device by supplying fresh air while drawing out ozone-containing air so as to maintain a low ozone concentration in the space around the charging device. U.S. Pat. No. 4,540,268 issued to Toyono et al. on Sept. 10, 1985 discloses a process kit mountable to an image forming apparatus. The process kit may include an ozone filter.

In recent years, there is a trend towards the personal use of copying apparatuses, laser beam printers and so forth, which has given a rise to the demand for reduction in the size and cost of these apparatuses. To cope with such a demand, a contact type charging device has been proposed in, for example, the specification of U.S. Pat. No. 4,851,960, in which an electrode with a comparatively low voltage applied thereto is made to materially contact a photosensitive member so that the photosensitive member is charged by a discharge taking place across a small gap between the electrode and the surface of the photosensitive member. The contact-type charging device have advantages, such as, small size and low voltage as compared, with corona chargers, as well as the elimination of the necessity for any charging-hysteresis erasing means, such as, pre-exposure means, thus meeting the demand for reduction in the size and price of the apparatuses. However, the contact-type charging device also generates ozone due to the discharge, so that ventilation is necessary in the region around the charging device.

FIG. 1 shows, in section, a typical known laser beam printer. This laser beam printer has a scanner unit 1 including a laser source, polygonal mirror and a correction lens system. The scanner unit emits a scanning laser beam modulated in accordance with an image signal. The laser beam is reflected by a reflection mirror 2 so as to be applied to the surface of a photosensitive drum 3. The photosensitive drum 3 has been uniformly charged by a charging device 4 which is typically a corona charger, so that an electrostatic latent image is formed on the surface of the photosensitive drum 3 as a result of application of the laser beam. The electrostatic latent image is developed by a developing device 5 so that a visible toner image is formed on the photosensitive drum. The toner image is then transferred to a transfer material 7 by means of a transfer charger 6 and is fixed to the surface of the transfer material 7 by a fixing device 8. Any residual toner remaining on the photosensitive drum 3 is removed by a cleaning device 9.

In this printer, the photosensitive drum 3, the charger 4, the developing device 5 and the cleaning device 9 are supported integrally so as to form an image forming unit K which is detachably and replaceably mounted on the stationary main part of the printer.

In operation of the printer, a fan 11 creates a flow of air which is introduced from the main part of the printer into the image forming unit K through a beam exposure opening 12 as indicated by an arrow A. The air is discharged through a discharge window 13 which is provided in a region between the charger 4 and the cleaning device 9 and extending in the longitudinal direction of the photosensitive drum 3, whereby ozone which is generated in the region around the charging device 4 is conveyed out of the printer.

However, the following problem is encountered when a contact-type charging device is used in place of the corona charger as the charging device 4. Namely, in such a case, air tends to stagnate near to the portion of the surface of the photosensitive drum 3 opposing the charger 4. In particular, the velocity of the air flow is extremely low at regions near both ends of the photosensitive drum 3 which closely oppose the inner surface of the unit K. Therefore, ozone can hardly be removed from the regions around the portion of the photosensitive member 3 opposing the charging device 4 particularly at both axial ends of the photosensitive drum. As a result, image defects such as blur or flow of image tend to occur at the portions near both axial ends of the photosensitive member.

In order to realize an efficient discharge of air from the region around the portion of the photosensitive drum 3 opposing the charging device 4, U.S. Pat. Application Ser. No. 497,889, filed Mar. 23, 1990, proposes an arrangement in which an air discharge window is formed in the wall of the unit K adjacent the charging device 4 and an air discharge duct is connected to the main part of the printer opposing the discharge window, so as to form a flow of air in the longitudinal direction of the photosensitive drum 3. This arrangement, however, undesirably increases the size and raises the cost of the printer due to provision of the air discharge duct. In addition, the mechanical strength of the unit K is reduced due to the provision of the discharge window.

SUMMARY OF THE INVENTION

Accordingly, an object of the present invention is to provide an image forming apparatus having a contact-type charging device, wherein ozone and other discharge products produced by the charging device contacting the image carrier are efficiently discharged to the outside of the printer, thereby suppressing generation of image defects such as blur or flow of image.

Another object of the invention is to provide an image forming apparatus which is reduced both in size and cost.

To these ends, according to one aspect of the present invention, there is provided an image forming apparatus including: a detachable image forming unit including an image carrier having a photosensitive layer, charging means for electrostatically charging the image carrier in contact therewith, and a housing supporting the image carrier and the charging means, the housing being provided with an exposure opening through which the image carrier is exposed to a light; and means for generating a flow of air which flows, when the image forming unit is in a predetermined mounting position in the apparatus, from regions near both longitudinal ends of the image carrier towards the exposure opening along a region where the charging means contacts the image carrier.

The invention in another aspect pertains to an image forming apparatus including a detachable image forming unit comprising an elongated, cylindrical carrier having a photosensitive layer, charging means for electrostatically charging the image carrier in contact therewith, developing means for forming a developed image on the image carrier, and a housing supporting the image carrier and the charging means, the housing being provided with an exposure opening through which the image carrier is exposed to a light; and means for generating a flow of air which flows, when the image forming unit is in the apparatus, from regions between the inner surfaces of the housing of the image forming unit and both longitudinal ends of the developing means towards the exposure opening.

The invention in yet another aspect pertains to an image forming apparatus including a detachable image forming unit comprising an elongated, cylindrical carrier having a photosensitive layer, charging means for electrostatically charging the image carrier in contact therewith, cleaning means for cleaning the image carrier and the charging means, the housing being provided with an exposure opening through which the image carrier is exposed to a light; and means for generating a flow of air which flows, when the image forming unit is in a predetermined mounting position in the apparatus, from regions between the inner surfaces of the housing of the image forming unit and both longitudinal ends of the cleaning means towards the exposure opening.

The present invention is a further aspect pertains to an image forming apparatus including a detachable image forming unit comprising an elongated, cylindrical carrier having a photosensitive layer, charging means for electrostatically charging said image carrier in contact therewith, developing means for forming a developed image on said image carrier, said developing means being contained within a casing, cleaning means for cleaning said image carrier, and a housing supporting said image carrier, said charging means and said cleaning means, said housing being provided with an exposure opening through which said image carrier is exposed to a light; and means for generating a flow of air which flows, when said image forming unit is in a predetermined mounting position in said apparatus, from regions between inner side surfaces of said housing of said image forming unit, proximate to both longitudinal ends of said image carrier, and side surfaces of said casing of said developing means, towards said exposure opening along a passage formed between a top of said casing of said developing means and said housing.

The above and other objects, features and advantages of the present invention will become clear from the following description when the same is read in conjunction with the accompanying drawings.

DESCRIPTION OF THE PREFERRED EMBODIMENTS

Preferred embodiments of the present invention will be described in detail with reference to the accompanying drawings.

Figure 1:
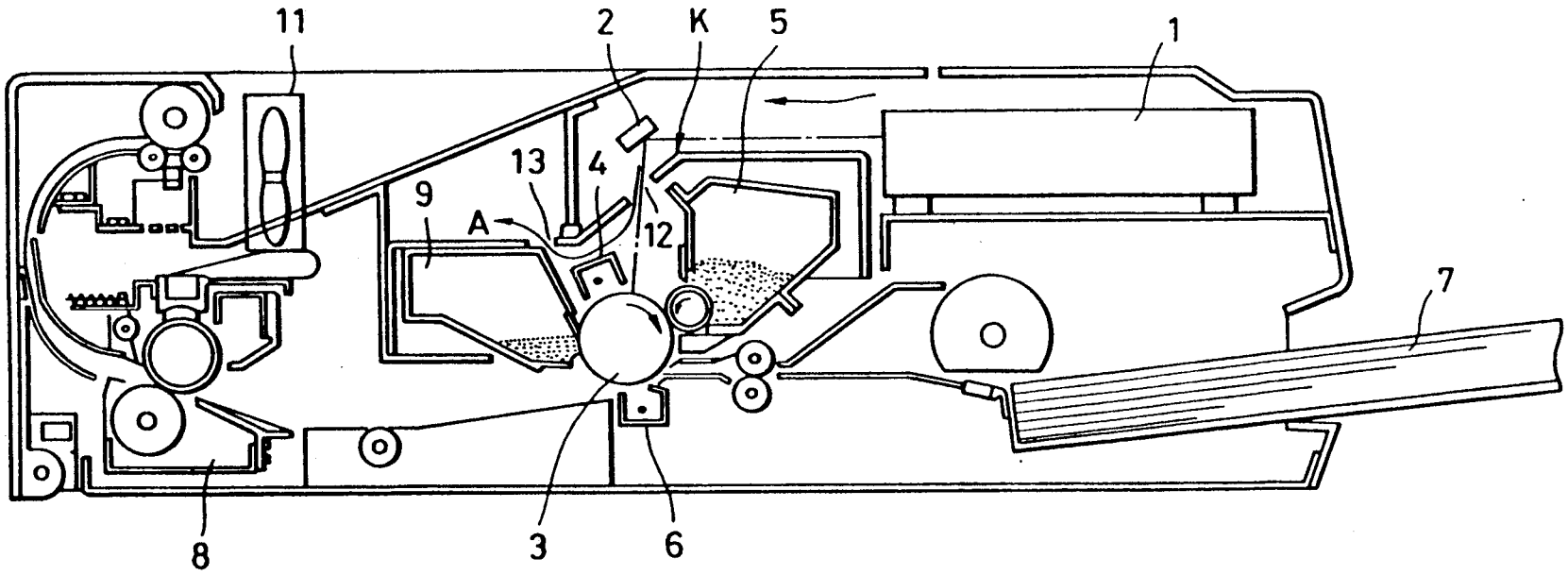
FIG. 1 PRIOR ART
FIG. 1 is a longitudinal sectional view of a conventional laser beam printer.
Figure 2:
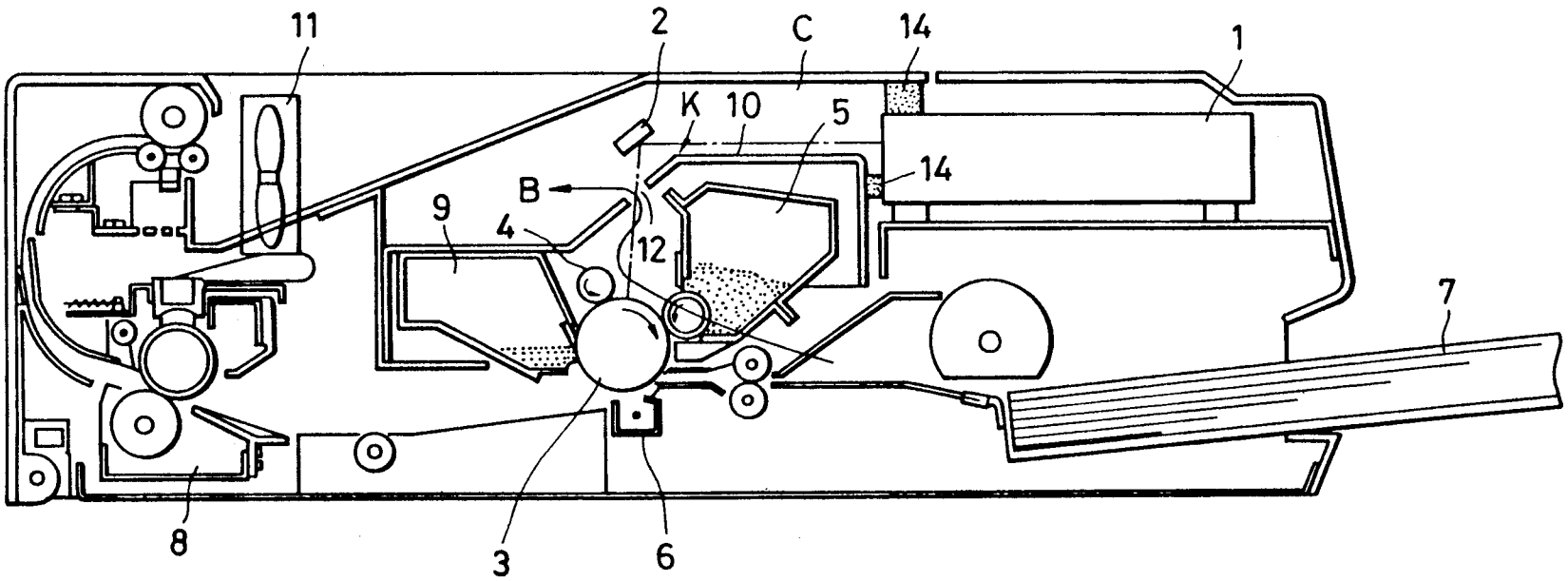
FIG. 2 is a longitudinal sectional view of a laser beam printer which is a first embodiment of the image forming apparatus of the present invention.

FIG. 2 is a longitudinal sectional view of a laser beam printer embodying the present invention. This laser beam printer has a scanner unit 1 including a laser source, polygonal mirror and a correction lens system. The scanner unit emits a scanning laser beam modulated in accordance with an image signal, The laser beam is reflected by a mirror 2 so as to be applied to the surface of a photosensitive drum 3 as an image carrier. In this case, the photosensitive drum 3 has an aluminum cylinder of 30 mm diameter, with the surface thereof coated with an organic photosensitive material, and is rotated at a process speed of 50 mm/sec. The laser beam printer has a charging device 4 which is a contact-type device having a charging roller to which is applied a voltage formed by superposing an A.C. voltage to a D.C. voltage. The photosensitive drum 3 is uniformly charged by the charging device 4, so that an electrostatic latent image is formed on the surface of the photosensitive drum 3 as a result of application of the laser beam. The charging roller has a metallic core member and a rubber roller layer made of a conductive rubber containing conductive powder particles dispersed therein. The above-mentioned voltage formed by superposing an A.C. voltage on a D.C. voltage is applied to the metallic core member. For instance, the metallic core member has a diameter of 6 mm and an EPDM (terpolymer of ethylenepropylenediene) having a volumetric resistivity of $10^2$ Ω·cm is coaxially wound on the metallic core member to provide a diameter of 12 mm. Then, a layer of epichlorohydrin rubber having volumetric resistivity of $10^9$ Ω·cm is formed on the EPDM layer, thus completing the charging roller. By contacting this charging roller with the photosensitive drum 3 while applying to the charging roller a voltage formed by superposing an A.C. voltage of 400 Hz and 1500 $V_{p-p}$ on a D.C. voltage of −650 V, it is possible to uniformly charge the photosensitive drum 3 to a potential of −650 V. The electrostatic latent image formed on the photosensitive drum 3 is developed by a developing device 5 so that a visible toner image is formed on the photosensitive drum. The toner image is then transferred to a transfer material 7 by means of a transfer charger 6 and is fixed to the surface of the transfer material 7 by a fixing device 8. Any residual toner remaining on the photosensitive drum 3 is removed by a cleaning device 9.

The photosensitive drum 3, the charging device 4, the developing device 5 and the cleaning device 9 are unitarily supported so as to form a unit K which is adapted to be replaceably mounted on the stationary main part of the laser beam printer through a guide means which is not shown. The illustrated construction of the unit K is only provided by way of example. Thus, any type of unit K having at least a photosensitive drum and a contact-type charging device can be used.

In this embodiment, with the unit K mounted in the right position of the unit K, a flow of air indicated by an arrow B is generated by a suction ventilation fan 11. Namely, air is induced into the unit K through a gap between the inner surface of the housing 10 of the unit K and the side surface of the vessel of the developing device 5 and is discharged through a beam exposure opening 12 through which the photosensitive drum 3 is exposed to the scanning beam. This flow of air conveys ozone generated around the charging device 4 to the exterior of the printer. In the illustrated embodiment, a shield member 14 is provided so as to block the flow of air through a space C in the upper region of the unit K so as to effectively supply fresh air into the unit K. The shield member may be made of moltprene which is a commercial name for a product made by INOAC corporation.

Figure 3:
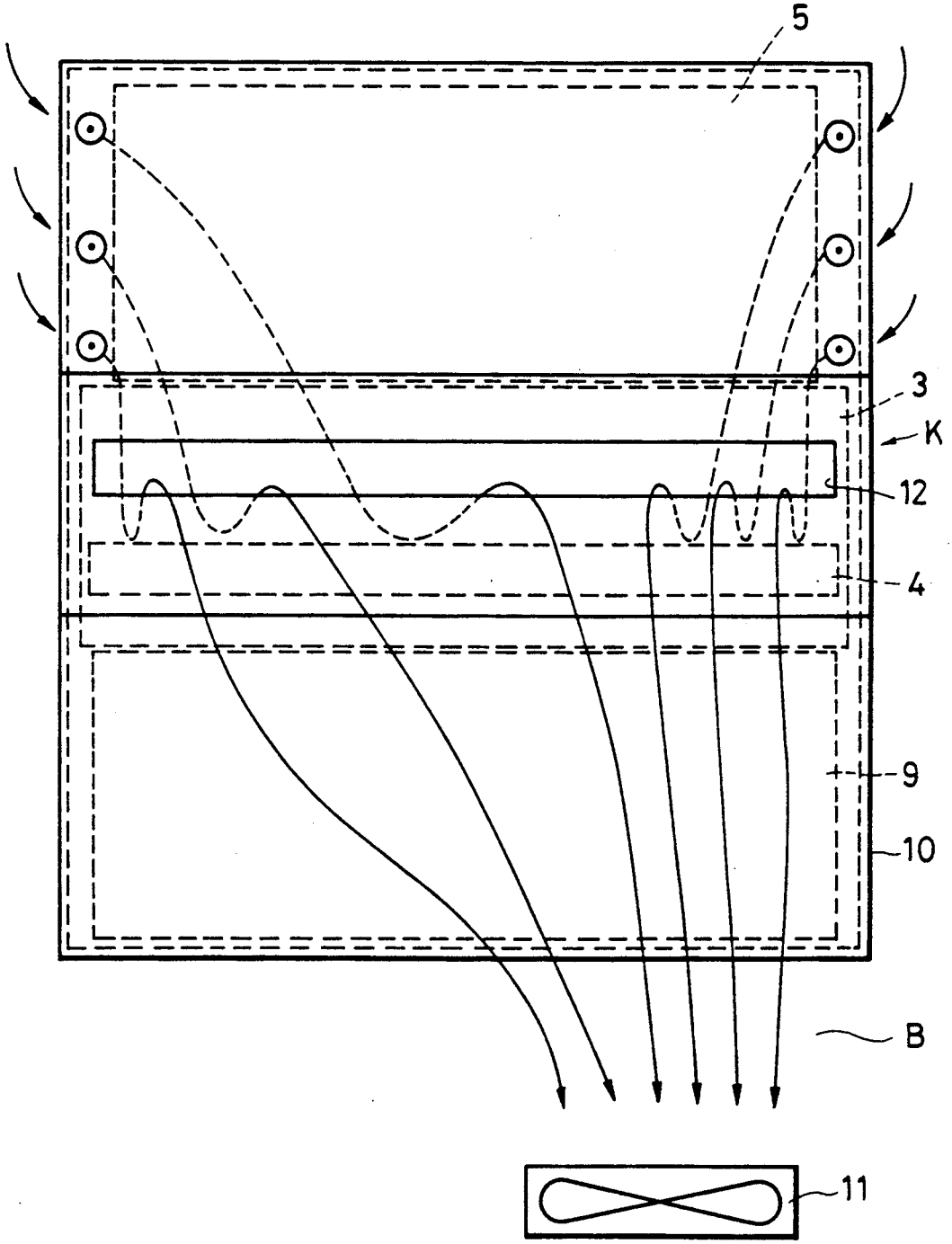
FIG. 3 is a plan view illustrating the flow of air in a region near a photosensitive drum unit in the laser beam printer shown in FIG. 1.

FIG. 3 is an illustration of the flow of air around the unit K in the printer of FIG. 2, as viewed from the upper top of the printer. Portions of the airflow are represented by arrows. Broken-line segments of the arrows show portions of the flow of air moving through the unit K, while solid-line segments indicate the portions of the flow of air outside the unit K. The air is induced into the unit K through the space between the inner surfaces of the housing 10 of the unit K and the outer surfaces of the developing device 5 and is made to flow in the region near the portion of the surface of the photosensitive drum 3 opposing the charging device 4. The air is then discharged to the exterior of the unit K through the beam exposure opening 12 and is then discharged to the outside of the printer by the suction ventilation fan 11. In FIG. 3, the mark • represents that the air flows from the reverse side to the obverse side of the plane shown in FIG. 3.

In this embodiment, as described above, air is drawn into the unit K through regions near both axial ends of the photosensitive drum 3 so that a large airflow velocity is obtained in the regions near both axial ends of the photosensitive drum 3 at a portion of the latter opposing the charging device 4, whereby ozone can be efficiently discharged from these regions, thus suppressing generation of image defects such as blur and flow of image. It is to be noted that this embodiment does not necessitate any specific ventilation window and air duct discharge in the wall of the housing of the unit K because the air can be discharged through the opening for the exposure to the beam, whereby a compact and inexpensive printer is obtained. In this embodiment, air is induced into the unit K through the regions between the inner surfaces of the housing 10 of the unit K and the adjacent surfaces of the developing device 5 and is discharged to the outside of the unit K through the beam exposure opening 12. This arrangement, however, is only illustrative and an equivalent effect can be obtained by arranging such that the air is introduced through regions between the inner surfaces of the housing 10 and adjacent surfaces of the cleaning device 9.

A second embodiment of the present invention will be printer as the second embodiment also has a scanner unit 1 by which the surface of a photosensitive drum 3 is scanned. The photosensitive drum 3 is uniformly charged by a charging device 4 which incorporates a charging roller similar to that used in the first embodiment. An electrostatic latent image is formed on the surface of the photosensitive drum 3 as a result of exposure to a modulated scanning laser beam, and the electrostatic latent image thus formed is developed by a developing device 5, whereby a toner image is formed. The toner image is transferred to a transfer material 7 by means of a transfer roller 6' to which a transfer bias voltage is applied, and is then fixed to the surface of the transfer material 7 by means of a fixing device 8. Residual toner particles remaining on the surface of the photosensitive drum are removed by a cleaning device 9.

Figure 5:
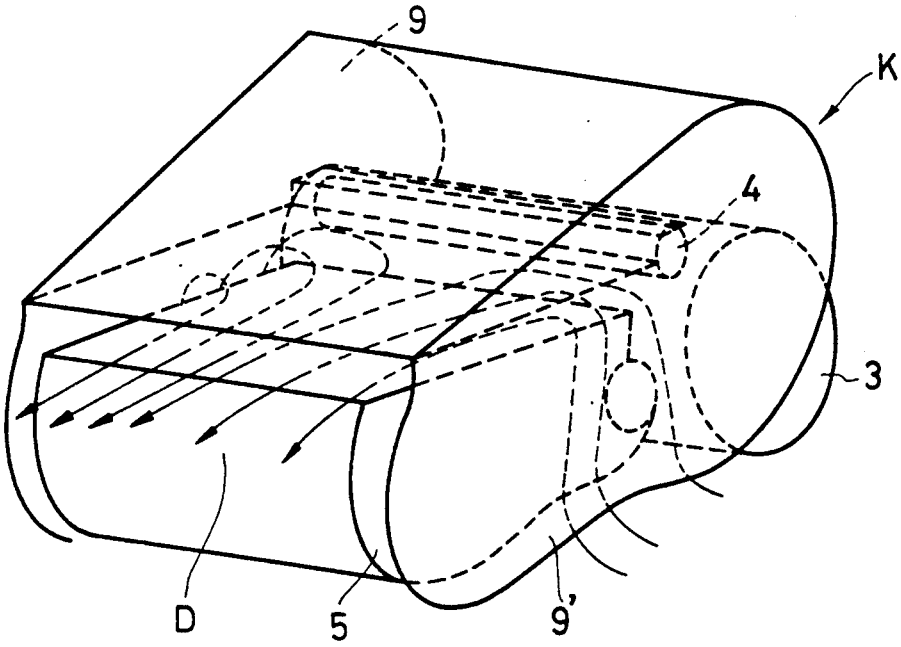
FIG. 5 is a plan view illustrating the flow of air in a region near a photosensitive drum unit in the laser beam printer shown in FIG. 3.

As will be seen from FIG. 5, the developing device 5, the photosensitive drum 3, the charging device 4 and the cleaning device 9 are unitarily supported to form a unit K. The side walls of the casing of the cleaning device 9 serve also as housing covers 9' which cover the photosensitive drum 3 and the developing device 5. When this unit K is mounted in the main part of the printer, the cleaning device 9 is disposed above the path of the exposure light and the developing device 5 is positioned below this path of exposure light. The unit K is adapted to be replaceably mounted at the right position in the stationary main part of the printer by means of a guide means which is not shown. In operation, air is induced into the unit K by the operation of a suction ventilation fan 11 through regions between the inner surfaces of the housing covers 9' and the outer surfaces of the casing of the developing device 5 and is discharged from the unit K through an exposure opening 12 through which the path of the exposure light extends. As a result, ozone generated in the region around the charging device 4 is discharged to the outside of the printer as indicated by arrows D in FIG. 5.

The suction ventilation fan 11 is disposed at an upper portion of the space inside the printer, in order to prevent an excessive temperature rise in the printer by the air heated by the fixing device 8. In consequence, an upward movement of air takes place in the printer so that air can be introduced into the unit K through the regions between the housing 10 of the unit K and the casing of the developing device 5 at a large flow rate and high velocity.

The air introduced into the unit K impinges upon the lower surface of the cleaning device 9 substantially perpendicularly thereto and, therefore, is uniformly distributed through the region around the charging device 4 before being extracted through the exposure opening, whereby the air around the charging device 4 can be efficiently replaced.

In this embodiment, the advantage of the invention is enhanced due to the positioning of the cleaning device 9 above the developing device 5.

Figure 6:
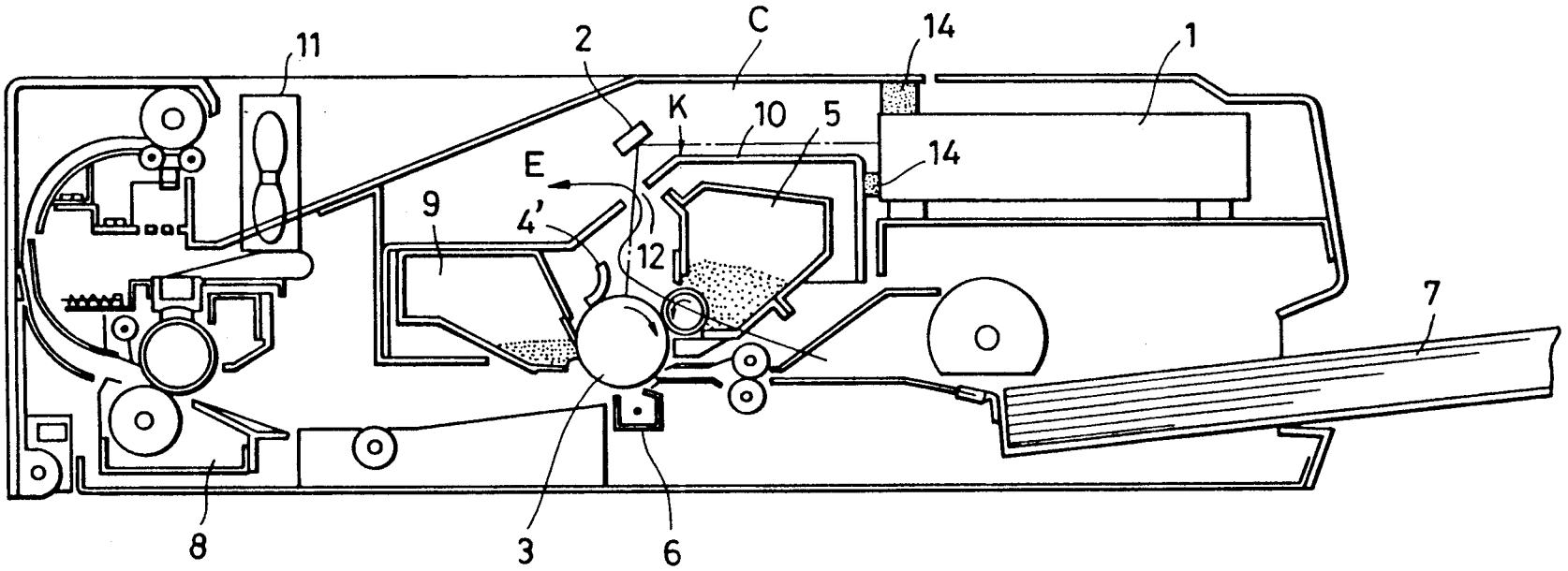
FIG. 6 is a longitudinal sectional view of a laser beam printer which is a third embodiment of the image forming apparatus of the present invention.
Figure 7:
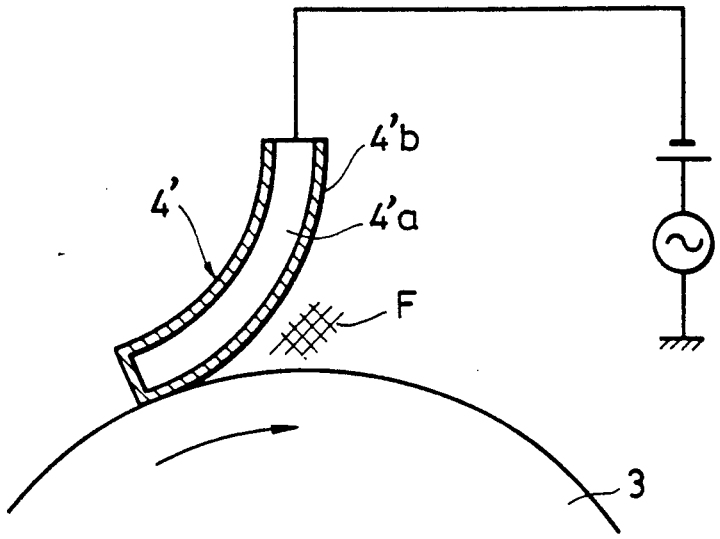
FIGS. 7 and 8 are schematic illustration of a charging device.
Figure 8:
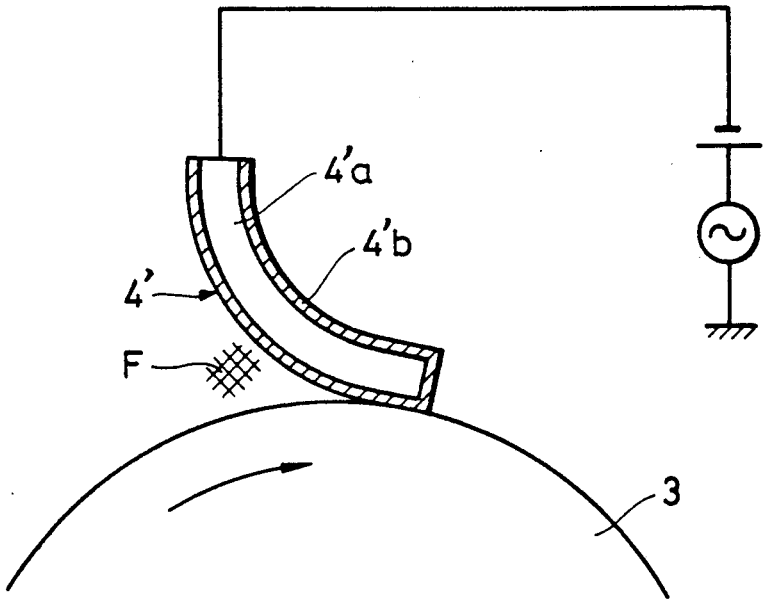

A third embodiment of the present invention will be described with reference to FIGS. 6 to 8. FIG. 6 is a longitudinal sectional view of a laser beam printer as a third embodiment of the present invention, while FIGS. 7 and 8 are illustrations of charging devices. The construction of the third embodiment is basically the same as that of the first embodiment, except that the charging device 4 has a blade-type charging member 4' (referred to as "charging blade" hereinafter) in place of the roller-type charging member used in the first embodiment.

Referring to FIG. 7, the charging blade 4' has a conductive strip 4' a which is made of urethane rubber having a volumetric resistivity of $10^2$ Ω·cm and which has a thickness of 2 mm, and a medium resistance layer 4'b for realizing uniform charging of the conductive strip 4'a. The medium resistance layer 4'b is formed by applying N-methoxymethylated nylon having a volumetric resistivity of $10^9$ Ω·cm to the conductive strip 4'a to a thickness of 30 82 m. The charging blade 4' is mounted in contact with the photosensitive drum 3 such that the distance between the charging blade 4' and the photosensitive drum 3 progressively increases in the direction of movement of the surface of the photosensitive drum 3. A voltage formed by superposing an A.C. voltage on a D.C. voltage is applied to the conductive blade 4'a so as to charge the photosensitive drum 3.

In operation, as in the case of the first embodiment, air is induced into the apparatus by the operation of a suction ventilation fan 11 so as to enter the space inside the unit K through the regions between the inner surfaces of the housing 10 of the unit K and the adjacent surfaces of the casing of the developing device 5. The air then is discharged through the beam exposure opening 12. As a result, ozone generated in the region around the charging blade 4' is conveyed out of the printer. As in the case of the first embodiment, the third embodiment has a shield member 14 made of, for example, moltprene so as to block the flow of air through the upper portion C of the space inside the unit K.

In this embodiment, the electric discharge takes place in a region indicated at F in FIG. 7, i.e., the region where the charging blade 4' opposes the photosensitive drum 3 across an air gap, so that generation of ozone takes place concentrically in this region. This region is surrounded by the charging blade 4', photosensitive drum 3 and the developing device 5. Therefore, by introducing fresh air into the unit K through the regions between the inner surfaces of the housing 10 of the unit K and the adjacent surfaces of the casing of the developing device 5, it is possible to efficiently carry the ozone away from the region around the charging blade 4'.

FIG. 8 shows a modification in which the charging blade 4' is mounted such that the distance between the charging blade 4' and the surface of the photosensitive drum 3 progressively decreases in the direction of movement of the surface of the photosensitive member 3. In such a case, the generation of ozone takes place concentrically in the zone defined by the charging blade 4', photosensitive drum 3 and the cleaning device 9. In this case, therefore, the arrangement is preferably such that fresh air is introduced into the unit K through the regions between the inner surfaces of the housing 10 of the unit K and the adjacent surfaces of the casing of the cleaning device 9.

As has been described, the present invention, which employs a specific form of a flow of air, makes it possible to efficiently convey ozone to the exterior of the image forming apparatus even when the charging device is of contact type which charges an image carrier in contact therewith. Accordingly, the generation of image defects such as, blur and flow of image, are eliminated, and a reduction in the size and cost of the image forming apparatus are achieved.

While the present invention has been described with respect to what is presently considered to be the preferred embodiments, it is to be understood that the invention is not limited to the disclosed embodiments. To the contrary, the present invention covers all modifications and equivalents included within the spirit and scope of the appended claims. The scope of the claims is to be accorded the broadest interpretation so as to encompass all such modifications, and equivalent structures.

What is claimed is:

1. An image forming apparatus comprising:

a detachable image forming unit comprising an elongated, cylindrical image carrier having a photosensitive layer, charging means for electrostatically charging said image carrier in contact therewith, and a housing supporting said image carrier and said charging means, said housing being provided with an exposure opening through which said image carrier is exposed to a light; and means for generating a flow of air which flows, when said image forming unit is in a predetermined mounting position in said apparatus, from regions near both longitudinal ends of said image carrier towards said exposure opening along a region where said charging means contacts said image carrier.

2. An image forming apparatus according to claim 1, wherein said means for generating a flow of air comprises a suction ventilation fan.

3. An image forming apparatus according to claim 1, wherein said charging means comprises a rotary charging member in rolling contact with said image carrier, and means for applying a predetermined voltage to said rotary charging member.

4. An image forming apparatus according to claim 1, wherein said charging means comprises a blade type charging member contacting said image carrier, and means for applying a predetermined voltage to said blade type charging member.

5. An image forming apparatus according to any one of claims 1, 2, 3 or 4, wherein said exposure opening formed in said housing of said image forming unit enables a latent image to be formed on said image carrier through a light exposure operation.

6. An image forming apparatus according to claim 1, wherein said image forming unit further comprises developing means for forming a developed image on said image carrier, and cleaning means for cleaning said image carrier.

7. An image forming apparatus comprising:

a detachable image forming unit comprising an elongated, cylindrical image carrier having a photosensitive layer, charging means for electrostatically charging said image carrier in contact therewith, developing means for forming a developed image on said image carrier, and a housing supporting said image carrier and said charging means, said housing being provided with an exposure opening through which said image carrier is exposed to a light; and means for generating a flow of air which flows, when said image forming unit is in a predetermined mounting position in said apparatus, from regions between the inner surfaces of said housing of said image forming unit and both longitudinal ends of said developing means towards said exposure opening.

8. An image forming apparatus according to claim 7, wherein said means for generating a flow of air comprises a ventilation fan.

9. An image forming apparatus according to claim 7, wherein said charging means comprises a rotary charging member in rolling contact with said image carrier, and means for applying a predetermined voltage to said rotary charging member.

10. An image forming apparatus according to claim 7, wherein said charging means comprises a blade type charging member contacting said image carrier, and means for applying a predetermined voltage to said blade type charging member.

11. An image forming apparatus according to claim 10, wherein said blade type charging member is held in contact with said image carrier such that the distance between said blade type charging member and said image carrier progressively increases in the direction of movement of the image-bearing surface of said image carrier, and wherein said flow of air is formed such that the air flows through regions between the inner surfaces of said housing of said image forming unit and the adjacent surfaces of said developing means towards said exposure opening.

12. An image forming apparatus according to any one of claims 7, 8, 9, 10 or 11, wherein said exposure opening formed in said housing of said image forming unit enables a latent image to be formed on said image carrier through a light exposure operation.

13. An image forming apparatus according to claim 7, wherein said image forming unit further comprises a cleaning means.

14. An image forming apparatus comprising:

a detachable image forming unit comprising an elongated, cylindrical image carrier having a photosensitive layer, charging means for electrostatically charging said image carrier in contact therewith, cleaning means for cleaning said image carrier, and a housing supporting said image carrier and said charging means, said housing being provided with an exposure opening through which said image carrier is exposed to a light; and means for generating a flow of air which flows, when said image forming unit is in a predetermined mounting position in said apparatus, from regions between the inner surfaces of said housing of said image forming unit and both longitudinal ends of said cleaning means towards said exposure opening.

15. An image forming apparatus according to claim 14, wherein said means for generating a flow of air comprises a ventilation fan.

16. An image forming apparatus according to claim 14, wherein said charging means comprises a rotary charging member in rolling contact with said image carrier, and means for applying a predetermined voltage to said rotary charging member.

17. An image forming apparatus according to claim 14, wherein said charging means comprises a blade type charging member contacting said image carrier, and means for applying a predetermined voltage to said blade type charging member.

18. An image forming apparatus according to claim 17, wherein said blade type charging member is held in contact with said image carrier such that the distance between said blade type charging member and said image carrier progressively decreases in the direction of movement of the image-bearing surface of said image carrier, and wherein said flow of air is formed such that the air flows through regions between the inner surfaces of said housing of said image forming unit and the adjacent surfaces of said cleaning means towards said exposure opening.

19. An image forming apparatus according to any one of claims 14, 15, 16, 17 or 18, wherein said exposure opening formed in said housing of said image forming unit enables a latent image to be formed on said image carrier through a light exposure operation.

20. An image forming apparatus according to claim 14, wherein said image forming unit further comprises a developing means.

21. An image forming apparatus comprising:

a detachable image forming unit comprising an elongated, cylindrical image carrier having a photosensitive layer, charging means for electrostatically charging said image carrier in contact therewith, developing means for forming a developed image on said image carrier, said developing means being contained within a casing, cleaning means for cleaning said image carrier, and a housing supporting said image carrier, said charging means and said cleaning means, said housing being provided with an exposure opening through which said image carrier is exposed to a light; and means for generating a flow of air which flows, when said image forming unit is in a predetermined mounting position in said apparatus, from regions between inner side surfaces of said housing of said image forming unit, proximate to both longitudinal ends of said image carrier and side surfaces of said casing of said developing means towards said exposure opening along a passage formed between a top of said casing of said developing means and said housing.

22. An image forming apparatus according to claim 21, wherein said means for generating a flow of air comprises a suction ventilation fan.

23. An image forming apparatus according to claim 21, wherein said charging means comprises a rotary charging member in rolling contact with said image carrier, and means for applying a predetermined voltage to said rotary charging member.

24. An image forming apparatus according to claim 21, wherein said charging means comprises a blade type charging member contacting said image carrier, and means for applying a predetermined voltage to said blade type charging member.

25. An image forming apparatus according to any one of claims 21, 22, 23 and 24, wherein said exposure opening formed in said housing of said image forming unit enables a latent image to be formed on said image carrier through a light exposure operation.

26. An image forming apparatus according to claim 21, wherein said developing means and said cleaning means are disposed in said image forming unit such that, when said image forming unit has been mounted in a predetermined mounting position in said apparatus, said cleaning means and said developing means substantially vertically oppose each other across a path of light leading to said exposure opening.

27. An image forming apparatus according to any one of claims 1, 7, 14 or 21, wherein said exposure opening is formed in said housing of said image forming unit so as to extend in the longitudinal direction of said image carrier.

* * * * *

UNITED STATES PATENT AND TRADEMARK OFFICE

CERTIFICATE OF CORRECTION

PATENT NO. : 5,038,174 Page 1 of 2

DATED : August 6, 1991

INVENTOR(S) : Junichi Kato, et al.

It is certified that error appears in the above-identified patent and that said Letters Patent is hereby corrected as shown below:

COLUMN 1:

Line 17, "as, a" should read --as a--.

Line 57, "have" should read --has--.

COLUMN 3:

Line 52, "is" should read --in--.

COLUMN 5:

Line 54, "mark · " should read --mark ⊙--.

Line 41, "upper top" should read --top--.

Figure 4:
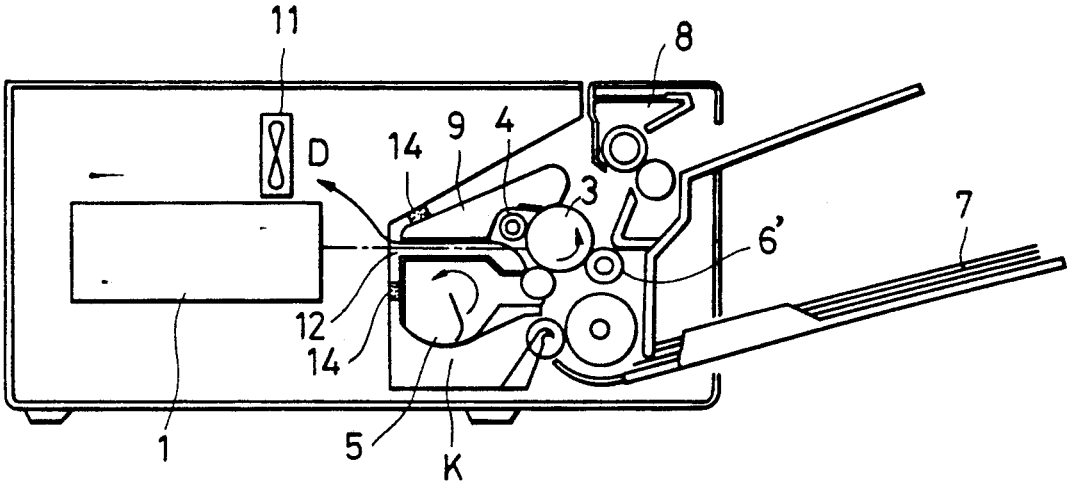
FIG. 4 is a longitudinal sectional view of a laser beam printer which is a second embodiment of the image forming apparatus of the present invention.

COLUMN 6:

Line 13, "be printer" should read --be described with reference to Figs. 4 and 5. A laser beam printer--.

UNITED STATES PATENT AND TRADEMARK OFFICE

CERTIFICATE OF CORRECTION

PATENT NO. : 5,038,174 Page 2 of 2

DATED : August 6, 1991

INVENTOR(S) : Junichi Kato, et al.

It is certified that error appears in the above-identified patent and that said Letters Patent is hereby corrected as shown below:

COLUMN 7:

Line 22, "30 82 m." should read --30μm.--

Signed and Sealed this

Ninth Day of March, 1993

*Attest:*

STEPHEN G. KUNIN

*Attesting Officer*

*Acting Commissioner of Patents and Trademarks*